US008893327B1

(12) United States Patent
Muhammad

(10) Patent No.: US 8,893,327 B1
(45) Date of Patent: Nov. 25, 2014

(54) BABY POD

(71) Applicant: Muriyd Abdullah Muhammad, Washington, DC (US)

(72) Inventor: Muriyd Abdullah Muhammad, Washington, DC (US)

(73) Assignee: Muriyd Abdullah Muhammad, Washington, DC (US)

( * ) Notice: Subject to any disclaimer, the term of this patent is extended or adjusted under 35 U.S.C. 154(b) by 0 days.

(21) Appl. No.: 13/964,225

(22) Filed: Aug. 12, 2013

(51) Int. Cl.
*A47D 13/02* (2006.01)

(52) U.S. Cl.
USPC ..... 5/101; 5/655

(58) Field of Classification Search
USPC ..... 5/93.1, 94, 101, 655
See application file for complete search history.

(56) References Cited

U.S. PATENT DOCUMENTS

D295,276 S * 4/1988 Brown et al. ..... D12/128
5,806,924 A * 9/1998 Gonas ..... 297/216.11

* cited by examiner

*Primary Examiner* — Fredrick Conley

(57) ABSTRACT

A baby pod is a hollowed-out circular shaped structure used to house new-born infants up to a year and a half age babies and other essential features associated with infant-to-toddler care in its interior shell. The outer and inner surface of the baby pod is smooth leaving the surface without any crevices to the outer shell or inner walls. The baby mattress is located in the cavity of a mattress box located at the bottom-center of the baby pod's interior. Baby pod has an outer solid flat base that surrounds the entire bottom to provide a secure and sturdy foundation to minimize unwanted sliding and movement and avoid tip overs. Towards the back of the baby pod just above the head of the baby mattress is a 180 degree-view viewing window. Towards the front of the baby pod just above the foot of the baby mattress is a huge entry opening that will allow for entry of an infant-to-toddler to be placed on the baby mattress. Starting from the top-center of the baby pod going towards the back in the direction of the 180 degree-view viewing window, is a ceiling window.

10 Claims, 4 Drawing Sheets

BABY POD

CROSS-REFERENCE TO RELATED APPLICATION

To my knowledge there are no existing provisional or non-provisional co-pending patents that this existing patent application can claim the benefit of priority.

BACKGROUND

Baby pod is an alternative sleeping platform for infants up to one and a half age babies.

The present invention relates to baby cribs and bassinets.

For many years infants and toddlers have been traditionally placed in a crib to keep them safe from rolling and falling out while they are sleeping. Cribs, Ref. (US 2013/0000037 A1, Tabbia), also provide an enclosed play area to put infants and toddlers in when parents have their attentions turned away.

unfortunately, baby cribs have also been at the center of many incidents involving infant injuries and deaths according to Consumer Product Safety Commission's (CPSC), "Statistical Data on Crib-Related Deaths Report."

Baby pod is utilized as a sleeping platform for infants up to toddler age babies. The only similarity baby pod has to the traditional baby crib is the baby mattress. Because of baby pod's unique hollowed-out smooth circular-structure shape, it does not have the parts and components Ref. (US 2012/0137429 A1, Aaron), and the defects and potential hazards that are associated with the traditional baby crib.

keeping in mind the defects and potential hazards of the traditional baby crib, when drafting this present invention, safety was not the only philosophical concern. Replacing the "squared prison cell-like shape" of the traditional baby crib to an circular shape is not only ideal for aesthetic pleasure but also for the environmental energy-flow of the infants and toddlers.

SUMMARY

The present application describes a baby pod. In one embodiment, the baby pod includes a hollowed-out circular structure with an outer solid flat base that surrounds the entire bottom base of the baby pod, a mattress box located at the bottom-center; a back lower panel located at the head of the mattress box and a front lower panel located at the foot of the mattress box; arching side walls located on both the right and left side of the mattress box; a baby mattress located in the cavity of the mattress box; a 180 degree-view viewing window is located above the back lower panel; a ceiling window located just above the 180 degree-view viewing window atop of the hollowed-out circular structure; a huge entry opening starting at the top-center of the hollowed-out circular structure making its way all the way from the sides to the front of the hollowed-out circular structure.

Because of baby pod's unique hollowed-out smooth circular structure it does not have the defects and potential hazards of the traditional squared-shaped baby cribs. It is one single structure without parts needed to be attached to the structure; no bars or cross-sections that may create potential hazards to life or limb of infants and toddlers associated with traditional baby cribs.

The unique hollowed-out smooth circular structure of baby pod gives the parents, infant and toddler an aesthetic appeal, one that is not provided by the "squared prison cell-like shape" traditional baby cribs.

DETAILED DESCRIPTION OF THE EMBODIMENT

Figure 1:
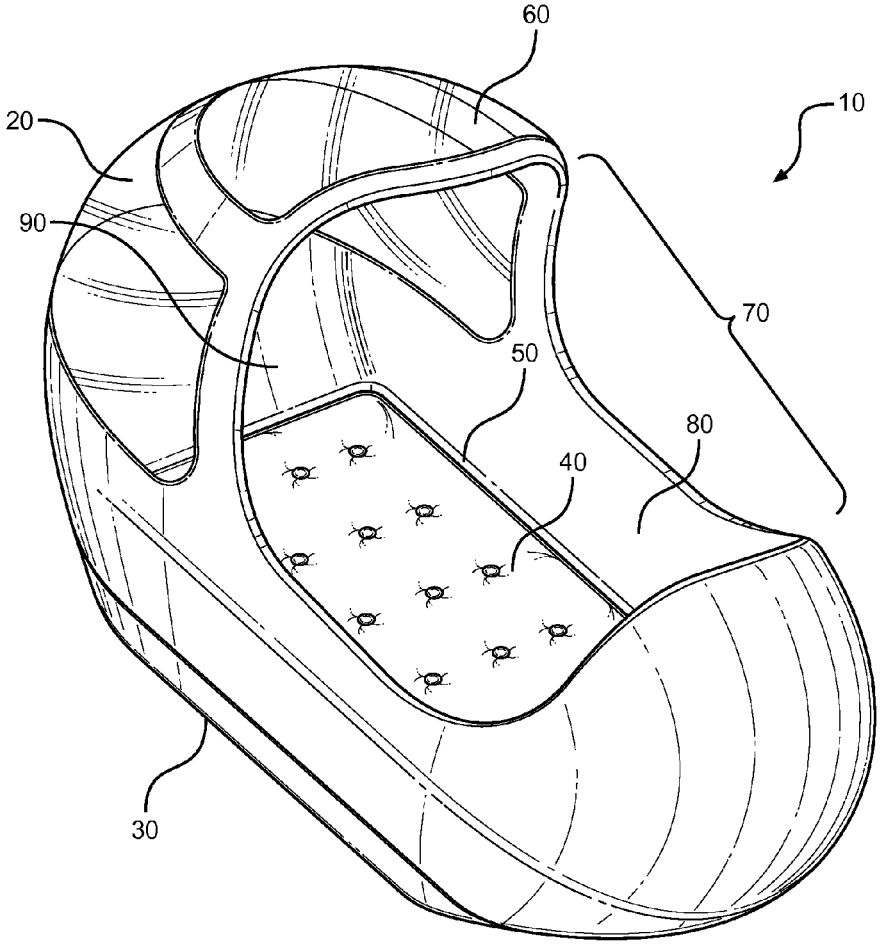
FIG. 1 is a perspective view of a baby pod.

Turning now to figures, FIG. 1 is a perspective view of a baby pod 10; Included is a outer solid flat base that surrounds the entire bottom base 30; a mattress box 50 located at the bottom-center interior, and a baby mattress 40 located in the cavity of the mattress box 50; a back lower panel 90 connected to the head of the mattress box 50 and rises up to connect to the back portion of the 180 degree-view viewing window 20; a arching left side wall 80 connects to the mattress box and rises up to support the left side portion of the 180 degree-view viewing window pane 20 and encompass the left side portion of the huge entry opening 70; a huge entry opening 70; a 180 degree-view viewing window 20 located at the back, and a ceiling window 60 located atop the baby pod.

Figure 2:
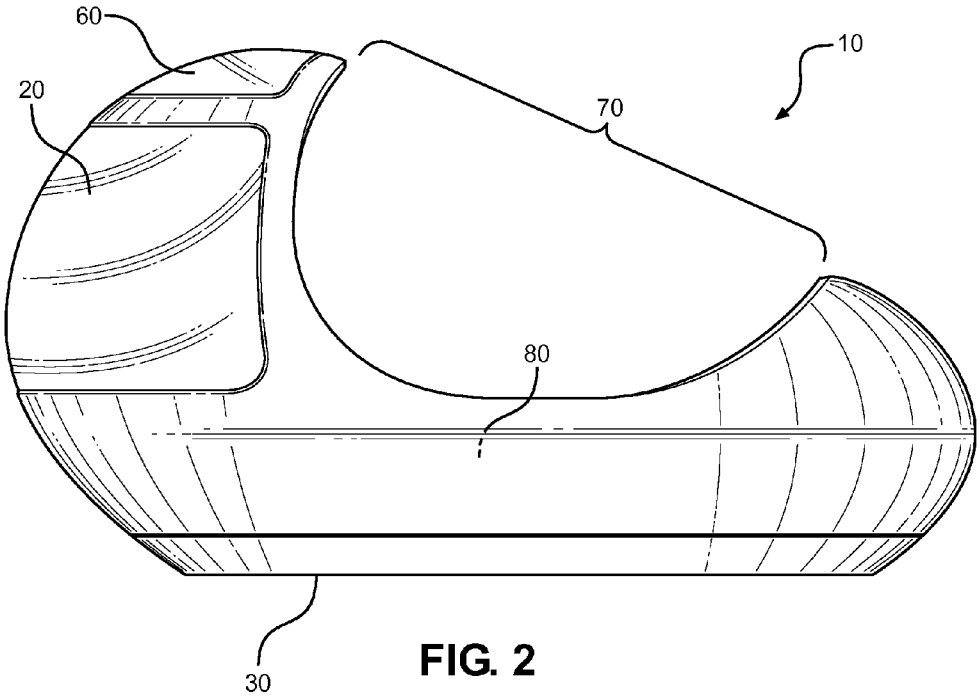
FIG. 2 is a side profile view of a baby pod.

Turning now to figures, FIG. 2 is a side profile view of a baby pod 10; Included is a outer solid flat base that surrounds the entire bottom base 30, an exterior arching right side wall 80 rising up to support the right side portion of the huge entry opening 70; a side-view of the huge entry opening 70; a right-side view of the 180 degree-view viewing window 20 located at the back, and a right-side view of the ceiling window 60 located atop the baby pod.

Figure 3:
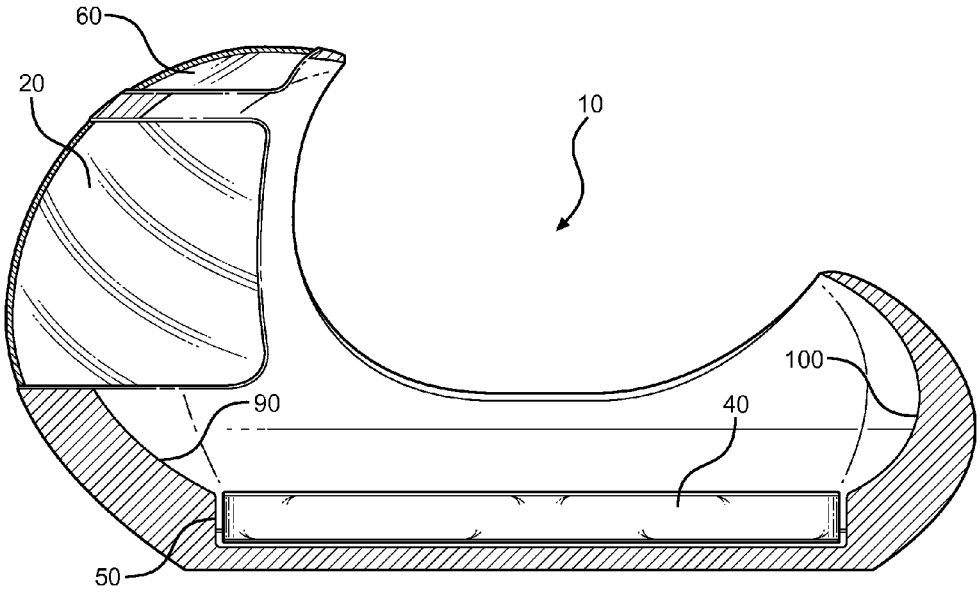
FIG. 3 is a transparent side profile view of a baby pod.

Turning now to figures, FIG. 3 is a transparent side profile view of a baby pod 10; Included is a mattress box 50 located in the bottom-center interior and a baby mattress 40 located in the cavity of the mattress box 50; a back lower panel 90 connected at the head of the mattress box 50; a front lower panel 100 connected to the foot of the mattress box 50; a right-side view of 180 degree-view viewing window 20, and a right-side view of the ceiling window 60 located atop the baby pod.

Figure 4:
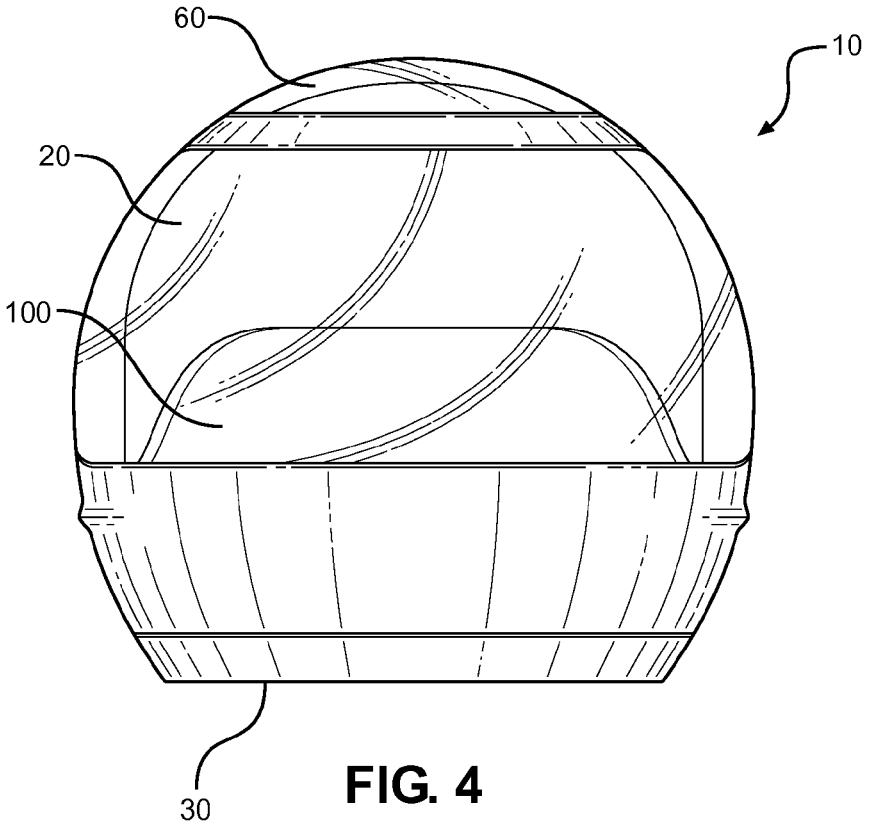
FIG. 4 is a back view of a baby pod.

Turning now to figures, FIG. 4 is a back view of a baby pod 10; included is a outer solid flat base that surrounds the entire bottom base 30; a view of the font lower panel 100 from the back of the baby pod; a back view of the 180 degree-view viewing window 20 from the exterior of the baby pod, and a back view of the ceiling window 60 from the exterior of the baby pod.

Figure 5:
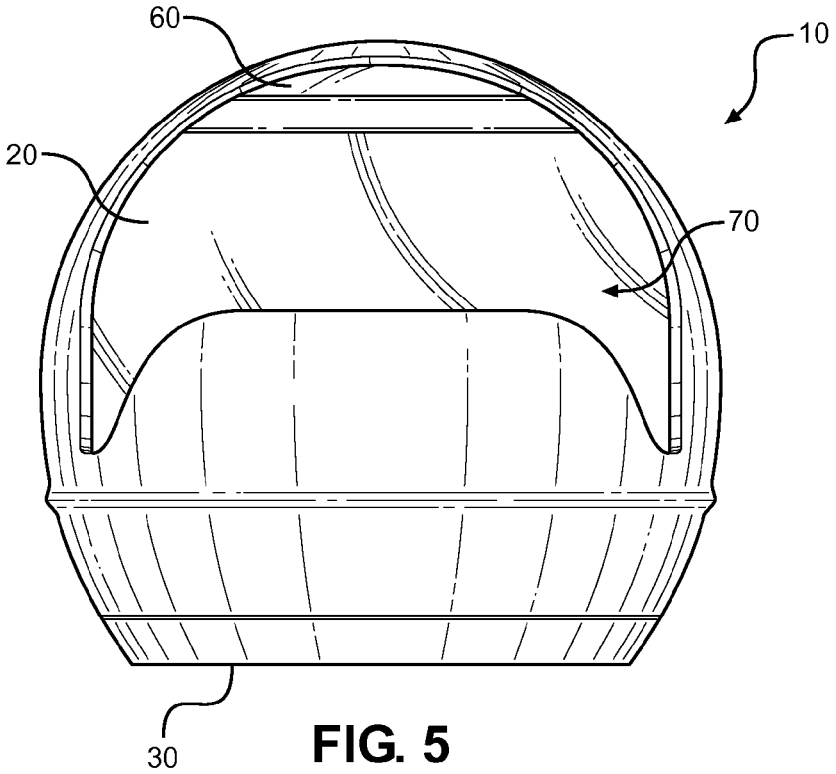
FIG. 5 is a front view of a baby pod.

Turning now to figure, FIG. 5 is a front view of a baby pod 10; Included is a outer solid flat base that surrounds the entire bottom base 30; a frontal view of the huge entry opening 70; a front view of the 180 degree-view viewing window 20 from the interior of the baby pod; and a slight front view of the ceiling window 60 from the interior of the baby pod.

Figure 6:
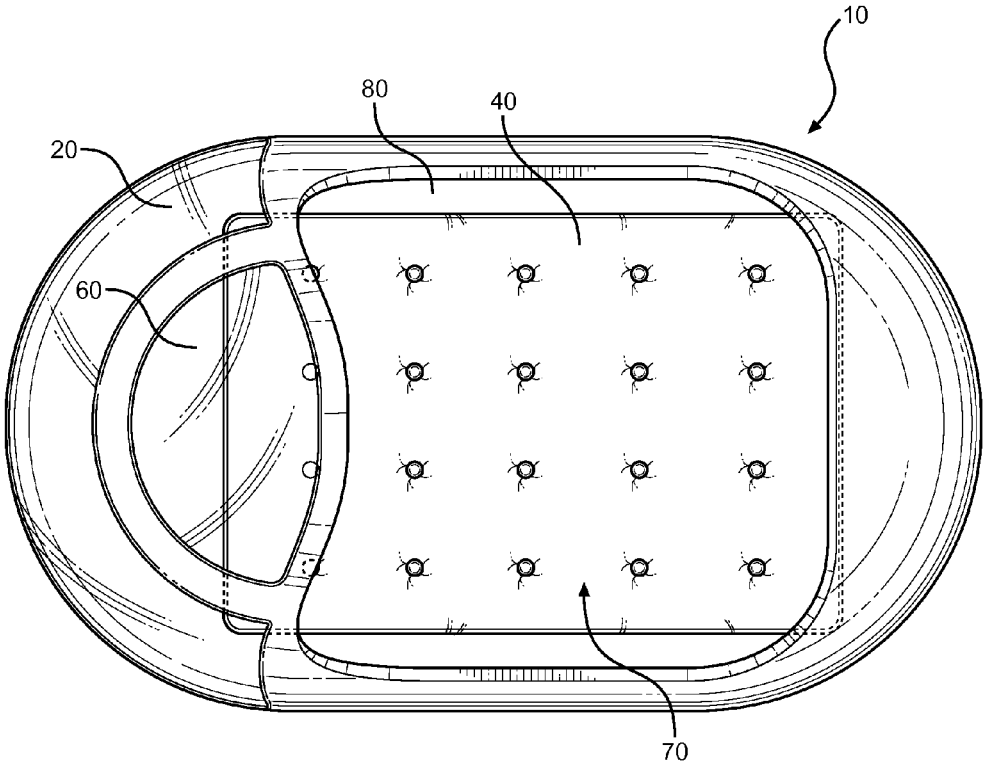
FIG. 6 is a transparent top/aerial view of baby pod.

Turning now to figures, FIG. 6 is a transparent top/aerial view of a baby pod 10; Included is a view of the baby mattress 40 from the interior of the "Baby Pod;" a partial top/aerial view of the right and left arching side walls 80; a top/aerial view of the huge entry opening 70; a top/aerial view of the 180 degree-view viewing window 20; and a top/aerial view of the ceiling window 60.

Because of baby pod's unique singular hollowed-out circular structure, it does not require tools to assemble. An ideal way of going about manufacturing a baby pod will take multiple steps to complete. First step would be to utilize baby pod's patent illustrations and computer-aided design (CAD)

software to assist in rendering an accurate and technical 3 dimensional (3-D) drawing (blueprint) of a baby pod.

Once an accurate and technical 3-D drawing (blueprint) of a baby pod is attained for mechanical engineering the second step can be accomplished in two methods. The $1^{st}$ method is utilizing 3-D printing/additive manufacturing to make a 3-D solid structure of the baby pod using the 3-D drawings (blueprint) and a technique called additive process, where successive layers of materials are laid down in different shapes. Depending on what 3-D printing machine is used, material or binding material is deposited on the build bed or platform of the machine until material/binder layering is complete and the final 3-D structure has been printed.

The $2^{nd}$ method and a more conventional way, would be a mold/moulding process, where the manufacturing of a baby pod is accomplished by shaping pliable raw material using a rigid frame or model called a pattern.

The third step would be concerning the manufacturing of the 180 degree-view viewing window 20, and the ceiling window 60 of a baby pod. Poly (methyl methacrylate) (PMMA), popularly known as Plexiglas, is an excellent choices given the desired safety for the infants and toddlers and the potential hazards of using glass. Plexiglas is a transparent thermoplastic, often used as a lightweight and shatter-resistant alternative to glass.

The fourth step would be acquiring the actual raw material components that will make up the hollowed-out circular shape structure of a baby pod 10.

The fifth step would be acquiring a standard size baby mattress 40 that fits the measurement and depth of the baby pod's mattress box 50.

The invention claimed is:

1. A baby pod comprising a hollowed-out circular structure with a mattress box at the base; a baby mattress within the cavity of the mattress box; a solid outer flat base that surrounds the bottom of the baby pod; an arching left and right side walls; a front and back lower panels; and a huge entry opening above the front lower panel at the front of the structure; a 180 degree-view viewing window above the back lower panel; and atop the surface of the baby pod is a ceiling window.

2. The baby pod according to claim 1, wherein the mattress box is supported at the bottom-center of the hollowed-out circular structure.

3. The baby pod according to claim 1, wherein the left arching side wall connects to the mattress box and rises up to support the left side portion of the 180 degree-view viewing window pane and encompass the left side portion of the huge entry opening to the hollowed-out circular structure; the right arching side wall connects to the mattress box and rises up to support the right side portion of the 180 degree-view viewing window pane and encompass the right side portion of the huge entry opening to the hollow-out circular structure.

4. The baby pod according to claim 3, wherein the left and right side arching walls rises up and joins together to form the top arching curvature openings of the hollowed-out circular structure.

5. The baby pod according to claim 1, wherein the front lower panel connects to and rises up from the foot of the mattress box, connects to the left and right side arching walls and encompass the front, left and right side portion of the huge entry opening towards the front of the hollowed-out circular structure; towards the back of the circular structure, the back lower panel connects to the head of the mattress box, and rises up to connect to the back portion of the 180 degree-view viewing window pane.

6. The baby pod according to claim 1, wherein the huge entry opening of the baby pod is formed by the right and left arching side walls and the front lower panel of the baby pod.

7. The baby pod according to claim 1, wherein the 180 degree-view viewing window is located at the back of the baby pod and it spans to some of the right and left side portion of the baby pod just above the back lower panel and just below the ceiling window.

8. The baby pod according to claim 1, wherein the ceiling window is located atop the hollowed-out circular structure just above the back portion of the 180 degree-view viewing window pane.

9. The baby pod according to claim 1, wherein the baby mattress is housed in the cavity of the mattress box supported at the bottom-center of the hollowed-out circular structure.

10. The baby pod according to claim 1, wherein the outer solid flat base surrounds the entire bottom base of the baby pod to provide a secure and sturdy foundation to minimize and avoid tipping over and unwanted sliding and movement.

* * * * *